United States Patent [19]

Mayville

[11] Patent Number: 4,671,177

[45] Date of Patent: Jun. 9, 1987

[54] TEMPERATURE RESISTANT DETONATOR

[75] Inventor: Wayne R. Mayville, Phoenix, Ariz.

[73] Assignee: Unidynamics Phoenix, Inc., Phoenix, Ariz.

[21] Appl. No.: 835,255

[22] Filed: Mar. 3, 1986

[51] Int. Cl.[4] ..... F42C 19/10

[52] U.S. Cl. ..... 102/204

[58] Field of Search ..... 102/204, 202.5, 202.14, 102/322

[56] References Cited

U.S. PATENT DOCUMENTS

| | | | |
|---|---|---|---|
| 547,850 | 10/1895 | Hathaway | 102/204 |
| 3,638,572 | 2/1972 | Menichelli | 102/204 |
| 3,978,791 | 9/1976 | Lemley et al. | 102/202.14 |
| 4,013,013 | 3/1977 | Davis | 102/277.1 |
| 4,144,814 | 3/1979 | Day et al. | 102/202.14 |
| 4,312,271 | 1/1982 | Day et al. | 102/202.14 |

OTHER PUBLICATIONS

"High Temperature Percussion Detonator", Unidynamics Phoenix, Inc. Drawing No. 51-1965.

*Primary Examiner*—Charles T. Jordan

*Attorney, Agent, or Firm*—Cahill, Sutton & Thomas

[57] ABSTRACT

A detonator is formed with a housing having an insert therein. The insert has an axial bore therethrough containing a primer charge, a donor charge and an output charge. The primer charge is carried in a cup like holder disposed in the insert bore and having flash holes therein providing continuity between the primer charge and the donor charge. The donor charge is separated from the output charge by a flyer plate and a barrel through which the flyer plate is propelled into the output charge upon detonation of the donor charge. An output disc at the end of the insert confines the output charge until it is detonated. The insert has spaced and radially displaced openings in the sidewall thereof in communication with the output charge and the donor charge to permit gas to escape from these charges when the detonator is subjected to elevated temperatures. The inside diameter of the housing is larger than a portion of the outside diameter of the insert to provide communication between the vent openings in the insert and the exterior of the detonator to permit the gasses to escape from the detonator. An open end of the housing is closed by a frangible closure disc having an opening therein which, in turn, is closed by a gas permeable cover disc. The closure disc and the cover disc permit gas to escape from the detonator but prevent contaminants from entering the interior of the detonator. The charges are mixtures of tetramethylammonium perchlorate and potassium perchlorate.

11 Claims, 6 Drawing Figures

TEMPERATURE RESISTANT DETONATOR

TECHNICAL FIELD

This invention is concerned with devices for reliably detonating an explosive charge under adverse, i.e. high temperature, conditions.

A detonator is a small explosive device for starting detonation of a main and much larger explosive charge. This invention is particularly concerned with an impact, or percussion, initiated detonator which is set off by driving a firing pin into a portion of the detonator housing an impact sensitive primer charge. This primer charge, once initiated, ignites other larger charges in the detonator, including a final output charge capable of generating sufficient energy to detonate the main explosive charge.

BACKGROUND ART

Explosive charges used by the oil industry in working deep wells are subjected to highly adverse conditions. Such charges and, obviously, the detonators employed to initiate explosion of the charges, must be capable of withstanding and remaining reliably operative in temperatures from 204° to 315° C. (400° to 600° F.) for periods up to 200 hours. Prior to this invention there have been no percussion initiated detonators capable of reliable operation above 218° C. (425° F.) for periods up to 200 hours.

Detonators designed for use in less harsh environments have been susceptible to two types of failures when subjected to prolonged high temperature environments. One type of failure results in premature detonator initiation because the temperature encountered causes ignition of the sensitive primer charge in the detonator. This causes detonation of the main explosive charge before it can be brought to the desired location in the well. The other type of failure renders the detonator useless because one or more of the charges therein disintegrate at high temperatures and provide insufficient energy to detonate the main explosive charge.

To prevent premature initiation failure the detonator must contain charges which are not subject to ignition when merely subjected to the elevated temperature. But, even with less temperature sensitive charges being used, the configuration of the detonator and its charges must be such as to generate sufficient explosive energy to detonate the main explosive charge. Known detonators do not possess this capability after long term exposure to temperatures above 218° C. (425° F.).

The prevention of detonator charge disintegration failure imposes further configuration requirements for the detonator. It has been known for some time that explosive charges of the type commonly used in detonators break down into gasseous components when subjected to elevated temperatures. It has also been recognized that unless provision is made for escape of these gasses from the body of the charge the presence of the gasses themselves contribute to and hasten further deterioration of the charge. It has, therefore, been proposed to provide a vent, or escape route, in the detonator for gasses emanating from the output charge of the detonator. Thus, although deterioration of the detonator charge may commence when the detonator is subjected to some predetermined high temperature, if provision is made for venting the out-gasses the rate of deterioration can be slowed to give the detonator a longer useful life at that elevated temperature. In other words, even after some extended period of time and with some limited deterioration of the charge, the charge will still contain sufficient energy to detonate the main explosive charge. A detonator with a vented output charge has been manufactured and sold by the assignee of this application, Unidynamics Phoenix Inc., of Phoenix, Ariz., under the brand name Geo Vann. So far as is known, no prior detonators were configured to vent any of the charges other than the output charge.

DISCLOSURE OF INVENTION

The improved detonator utilizes an insert having an axial bore therethrough containing a percussion initiated primer charge at one end and an output charge at the opposite end. The detonator also preferably has a donor charge adapted to be ignited by the primer charge and capable of propelling a flyer plate through a barrel in the insert into contact with the output charge. The flyer plate strikes the output charge with sufficient impact energy to detonate the output charge.

The insert has spaced openings in the sidewall thereof extending into the bore therein to permit the escape of gasses emanating from the charges in the detonator when the detonator is subjected to high temperatures. The insert is disposed in a housing which provides communication between the vent openings in the insert sidewall and the exterior of the detonator.

The detonator construction is such that a single explosive mixture can be utilized for all three charges in the detonator. The preferred explosive is a mixture of tetramethylammonium perchlorate (TMAP) and potassium perchlorate (KP). This mixture has all of the desirable characteristics enabling it to be percussion initiated as a primer charge, to be pyrotechnically initiated as a donor charge and again percussion detonated with a flyer plate as an output charge, and giving sufficient energy output to detonate a main explosive charge. This material has the further characteristic of resisting serious deterioration in a 315° C. environment for up to 200 hours when utilized in the vented insert previously described.

BRIEF DESCRIPTION OF THE DRAWING

The invention is described in greater detail hereinafter by reference to the accompanying drawing wherein.

BEST MODE FOR CARRYING OUT THE INVENTION

Figure 1:
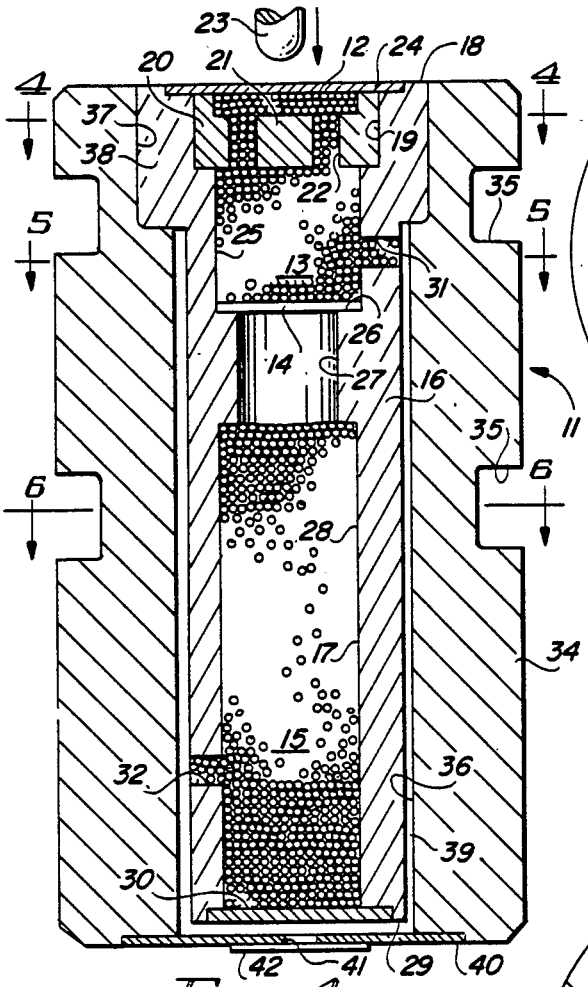
FIG. 1 is a longitudinal sectional view through a percussion initiated detonator embodying this invention.
Figure 3:
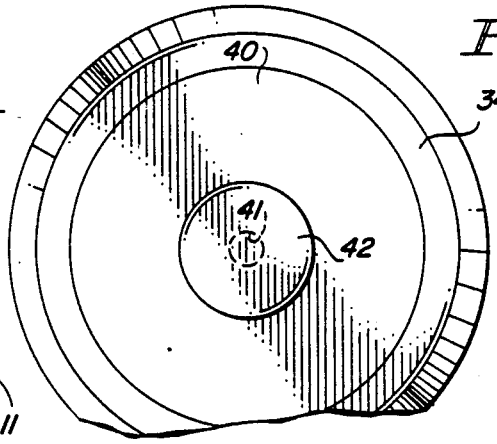
FIG. 3 is a partial end view of the output end of the detonator of FIG. 1.

The preferred form of detonator embodying this invention is illustrated in the drawing and is designated generally by reference numeral 11. Detonator 11 is a progressive energy device in which a light percussion force is utilized to ignite a small primer charge 12 which, in turn, ignites a larger donor charge 13 which, in turn, develops sufficient explosive gas pressure to drive a flyer plate 14 into an even larger output charge 15 which, in turn, emits sufficient explosive energy to detonate a main explosive body, or charge, (not shown) with which the detonator is associated. The multi-charge, progressive energy detonator is characterized by its ability to safely and reliably convert a small amount of energy into the level of energy required to set off the main high-explosive charges of the type commonly used in industrial applications, such as oil well working.

The detonator 11 of this invention is specifically configured to perform under the adverse conditions encountered in deep oil well working where the detonator may be subjected to temperatures in the range of 260° to 315° C. (500° to 600° F.) for periods of as much as 200 hours in length. The detonator of this invention is capable of functioning in this environment because it possesses two features not possessed by prior detonators. The first feature is the result of the configuration of the detonator which allows gasses that are invariably released from the charges when they are subjected to high temperatures to escape from the detonator so that they do not contribute to further, more rapid deterioration of the charges. The second feature stems from the identification of a particular charge mixture which has not heretofore been used in detonators, but which has proven to be particularly suitable for use in a detonator intended for use in high temperature environments.

Figure 4:
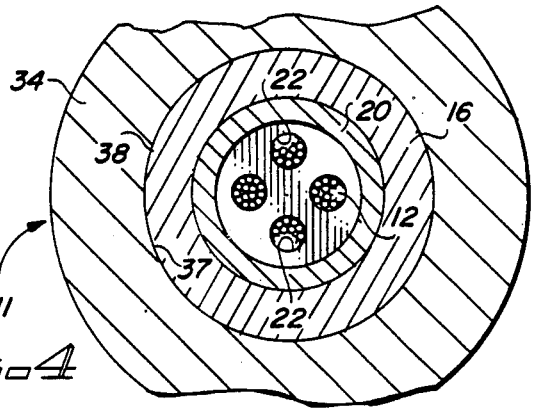
FIG. 4 is a partial sectional view through the detonator taken generally as indicated by the line 4—4 in FIG. 1.
Figure 5:
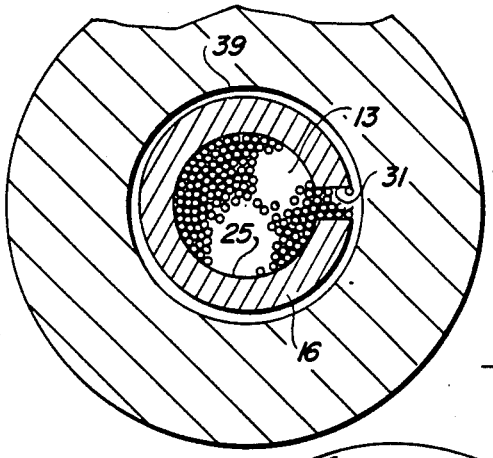
FIG. 5 is a partial sectional view through the detonator taken generally as indicated by the line 5—5 in FIG. 1.
Figure 2:
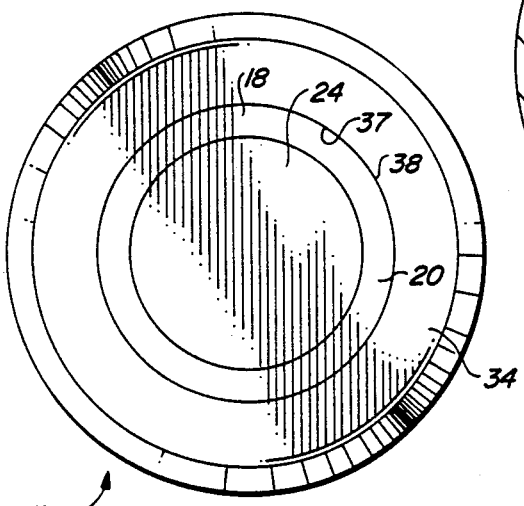
FIG. 2 is an end view of the primer, or percussion, end of the detonator of FIG. 1.
Figure 6:
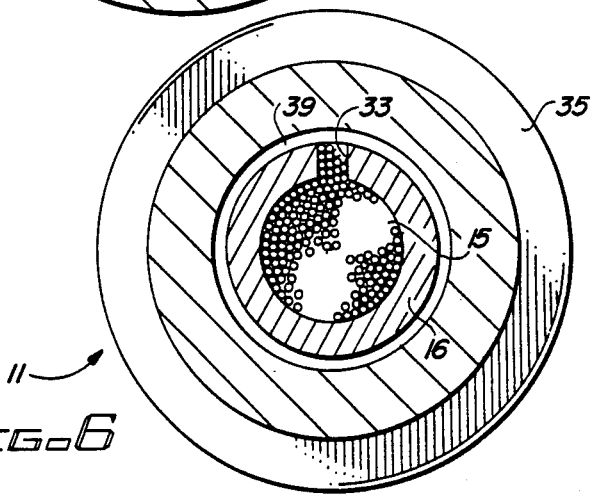
FIG. 6 is a partial sectional view through the detonator taken generally as indicated by the line 6—6 in FIG. 1.

Referring particularly to FIG. 1, the preferred configuration of detonator 11 includes a cylindrical insert 16 having a bore, or series of bores, 17, therein in which charges 12, 13 and 15 are disposed. Bore 17 in the percussion end 18 of insert 16 is enlarged at 19 to receive a primer charge holder 20 having a central anvil region 21 surrounded by a plurality of flash holes 22 (see FIG. 4) which are filled with primer charge 12.

Percussion initiation, or ignition, of primer charge 12 is effected by driving a firing pin 23 against a deformable primer disc 24 crushing a middle region of the primer charge 12 between the disc and anvil region 21 of charge holder 20. Primer disc 24 closes the percussion end of insert 16 and may be welded in place thereon.

When initiated, the burning of primer charge 12 proceeds throughout the charge and through flash holes 22 into the somewhat larger body of donor charge 13. Donor charge 13 is contained within an intermediate region 25 of bore 17 and is compressed between primer charge holder 20 and flyer plate 14 which has its periphery resting on a shoulder 26 formed in bore 17 between intermediate region 25 and a somewhat smaller diameter open barrel 27. The opposite end of barrel 27 communicates with an enlarged cavity 28 in bore 17 which houses the even larger output charge 15.

The function of flyer plate 14 is to insure that the total amount of energy available from donor charge 13 is utilized in the process of initiating detonation of output charge 15. Flyer plate 14 accomplishes this by confining donor charge 13 within region 25 of bore 17 until substantially the entire body of the donor charge has ignited. The detonator is designed so that when this has been achieved the explosive gasses emanating from donor charge 13 will build up sufficient pressure to rupture flyer plate 14 and drive a substantial portion of the flyer plate through barrel 27 into contact with output charge 15. The flyer plate 14 possesses sufficient kinetic energy to detonate output charge 15 on impact.

The utilization of flyer plate 14 within detonator 11 can be viewed as a safety feature. Because the flyer plate with-holds the transfer of energy to the output charge 15 until all of the explosive energy available from donor charge 13 and primer charge 12 is available for this purpose the size and sensitivity of the latter two charges can be held to a minimum. Without the flyer plate, more sensitive and larger primer and donor charges would be required to insure detonation of the output charge 15 because the energy from these preliminary charges would likely be applied to the output charge incrementally over some extended period and therefore less efficiently than is achieved with the instantaneous impact of the flyer plate.

The output end 29 of insert 16 in closed by an output disc 30 which is preferably welded to the insert to retain and closely confine output charge 15.

As mentioned previously, it is a significant feature of this invention that the charges within detonator 11 are vented so that gasses emanating from the charges 12, 13 and 15 as a result of their being subjected to high temperature are permitted to escape from the bodies of the charges. For this purpose, the insert 16, which contains charges 12, 13 and 15, has openings provided in the sidewall of the insert communicating with the insert bore 17. Specifically, the insert preferably has at least one vent hole, or opening, 31 near the percussion end 18 of insert 16 to vent the donor charge 13 and the primer charge 12 which is in communication with the donor charge through flash holes 22 in the primer charge holder 20. The insert 16 also preferably has at least one other vent hole 32 near the output end 29 of the insert for venting the output charge 15. Because of the size of the output charge 15 it may, in some instances, be desirable to provide a third vent hole 33 to another region of the main charge 15 near the longitudinal middle of the detonator 11. The three vent holes 31, 32 and 33 extend radially outwardly from the bore 17 of insert 16 and are preferably arranged with their axes angularly displaced, or radially offset, from each other. In other words, the vent holes are displaced around the periphery of the insert 16 as opposed to being in a longitudinal line along the insert. This avoids creating a line of weakness along the wall of the charge containing insert 16

A detonator 11 which is designed to be inserted in the field into a receptor forming a part of the main explosive charge will ordinarily have a housing 34 surrounding the insert 16. The purpose of the housing 34 is to provide physical protection for the charges 12, 13 and 15 in insert 16 and to serve as a connector between the insert 16 and the receptor of the main explosive charge. The housing 34 may have one or more grooves 35 on the outer surface thereof to receive an appropriate sealing mechanism (not shown) associated with the main charge receptor. Housing 34 has a bore 36 for receiving insert 16. At the percussion end 18 of the detonator 11 the bore 36 of housing 34 is enlarged as at 37 for tightly receiving an enlarged flange like region 38 of insert 16. The remainder of bore 36 in housing 34 is slightly larger in diameter than the outside diaxeter of the remainder of the insert 16 so as to provide an annular space 39 which forms a flow path, or escape route, for gasses emanating from vent holes 31, 32 and 33. These gasses exit the bore 36 of housing 34 at the output end of the detonator.

To prevent contamination of the charges 12, 13 and 15 in the detonator 11 by foreign matter entering bore 36 of housing 34 the output, open end of the housing 34 is preferably closed by means of a frangible closure disc 40. However, in order to provide for the exit of out-gasses from the charges 12, 13 and 15, the closure disc 40 is provided with a vent hole 41 wich is covered by a gas permeable cover disc 42. The cover disc 42 may be made, for example, from polyimide plastic sheet material backed with an adhesive to adhere the disc to the closure disc 40. The combination of closure disc 40 and gas permeable cover disc 42 prevents contamination of the charges in the detonator 11, but permits the escape of products out-gassing from these charges when the detonator is subjected to high temperature conditions. By this arrangement these gasses do not remain in the charges and cause further or additional deterioration of the charges. This enables the detonator 11 to remain in an operable condition for an extended period of time even though it is being subjected to temperatures which cause some deterioration of the charges therein.

It should be understood that a spearate housing 34 may not be required for the vented insert 16 in some applications. In some instances the insert 16 may be preassembled with the explosive charge or an explosive train and the apparatus associated therewith can serve the function of a housing for the insert. In those applications, of course, provision must be made for escape of the gasses vented from the charges.

Another feature of the detonator 11 constructed in accordance with this invention centers on the materials used to form the charges 12, 13 and 15 of the detonator. It has been discovered that a mixture of tetramethylammonium perchlorate (TMAP) and potassium perchlorate (KP) can be utilized as and function well for all three of the charges, namely the primer charge 12, the donor charge 13, and the output charge 15. Such materials are usually thought of as being propellants rather than explosives of the type used in charges for detonators. Nevertheless, it has been determined that when uniformly mixed in ratios of anywhere from approximately 48 parts TMAP to approximately 52 parts KP to approximately 52 parts TMAP to approximately 48 parts KP that the mixture can be satisfactorily utilized in these three charge applications.

The TMAP-KP charge mixtures referred to above tend to experience exotherm, i.e. begin to deteriorate, when subjected to temperatures approximating 385° C. (725° F.) and experience peak exotherm, or complete disintegration, in the vicinity of 405° C. (760° F.). The materials thus, are well capable of withstanding the 260° to 315° C. (500° to 600° F.) range expected to be encountered in deep oil well working.

The TMAP-KP mixtures also exhibit a 50% all fire impact sensitivity level of from approximately 100 kgcm to approximately 110 kgcm and therefore possess sufficient sensitivity to enable them to function as the percussion initiated primer charge 12 and the flyer plate initiated main charge 15. On the other hand, the mixtures exhibit no tendancy to ignite when subjected to friction imposed between porcelain surfaces using a 1 kg mass on the Light Model Bam Friction Tester. Thus, unlike many prior ultrasensitive primer materials the TMAP-KP mixtures are relatively safe when being handled for loading the detonator.

The TMAP-KP mixtures further possess sufficient energy to meet all of the requirements normally made of a detonator used for industrial explosive applications. These materials have demonstrated a calorific output as determined by means of the Parr Oxygen Bomb Calorimeter of from approximately 1200 cal/grm to approximately 1320 cal/grm and a theoretical impetus, or output for detonating a main charge, of at least 8700 inlb/gn using the minimization of Free Energy Technique PEP CALC procedure.

There may be other explosive substances possessing the above identified characteristics which would function in the configuration of the detonator 11 provided in accordance with this invention. However, it has been determined that the TMAP-KP mixtures function particularly well in any one or all three of the charges in the detonator.

What is claimed is:

1. A detonator comprising an insert having a bore therethrough, the bore in said insert being closed at one end by a deformable primer disc and closed at its other by an output disc, a primer charge disposed in the bore adjacent said primer disc, a donor charge disposed in said bore in communication with said primer charge, an output charge disposed in said bore adjacent said output disc, said donor charge and said output charge being separated by an open barrel and by a flyer plate disposed ajdacent said donor charge, said insert having openings in the wall thereof providing vents communicating with said donor charge and said output charge, respectively.

2. The detonator of claim 1 further characterized in that at least one of said charges is a mixture of tetramethylammonium perchlorate and potassium perchlorate.

3. The detonator of claim 1 further characterized in that all three of said charges are mixtures of tetramethylammonium perchlorate and potassium perchlorate.

4. The detonator of claim 1 further comprising a housing containing said insert, said housing providing communication between the vent openings in said insert and the exterior of said housing.

5. The detonator of claim 4 further characterized in that the housing sealingly engages said insert in the vicinity of said one end of the bore therein, said housing having an opening herein aligned with the said other end of the bore in said insert, a closure disc closing the opening in said housing, said closure disc having an opening therein, and a gas permeable cover disc for the vent opening in said closure disc.

6. The detonator of claim 4 further characterized in that said insert has a generally cylindrical configuration and said housing has a generally cylindrical configuration.

7. The detonator of claim 1 further characterized in that the vent openings in the wall of said insert are displaced radially from each other in said insert.

8. A detonator comprising an insert having a series of bores therein containing respectively a primer charge, a donor charge and an output charge, means providing communication between said primer charge and said donor charge, a barrel in said insert between said donor charge and said output charge, a flyer plate separating said donor charge from said barrel, vent means in said insert communicating with said donor charge and said output charge, a housing containing said insert, and means in said housing providing communication between the vent means in said insert and the exterior of the housing.

9. The detonator of claim 8 further characterized in that said charges are mixtures of tetramethylammonium perchlorate and potassium perchlorate.

10. The detonator of claim 8 further characterized in that said communication means in said housing includes a gas permeable closure preventing contaimination of the interior of said housing.

11. The detonator of claim 8 further characterized in that the insert has a generally cylindrical configuration and the housing has a generally cylindrical configuration and the inside diameter of at least a portion of said housing is larger than at least a portion of said insert to provide the communication means in said housing.

* * * * *